US008601631B1

(12) United States Patent
Martin

(10) Patent No.: US 8,601,631 B1
(45) Date of Patent: Dec. 10, 2013

(54) CLEANING BRUSH ASSEMBLY

(76) Inventor: Lewis B. Martin, Houston, TX (US)

( * ) Notice: Subject to any disclaimer, the term of this patent is extended or adjusted under 35 U.S.C. 154(b) by 0 days.

(21) Appl. No.: 13/563,950

(22) Filed: Aug. 1, 2012

(51) Int. Cl.
*A46B 13/04* (2006.01)

(52) U.S. Cl.
USPC ..... 15/29; 15/50.1

(58) Field of Classification Search
USPC ..... 15/28, 29, 49.1, 79.2, 50.1
See application file for complete search history.

(56) References Cited

U.S. PATENT DOCUMENTS 5,282,290 A * 2/1994 VanFossen ..... 15/49.1
5,649,334 A 7/1997 Henriquez et al.
5,913,982 A 6/1999 Phillips
5,987,682 A 11/1999 Rossi
6,058,543 A 5/2000 Thompson
D465,928 S 11/2002 Solivan
6,487,746 B1 12/2002 Cioci
6,915,541 B2 7/2005 Alexander
2007/0264075 A1 11/2007 Panasci et al.

* cited by examiner

*Primary Examiner* — Randall Chin

(57) ABSTRACT

A cleaning brush assembly is provided for facilitating cleaning of curved surfaces such as the interior of bathtub. The assembly includes a handle and a central housing coupled to a lower end of the handle. A first side housing is pivotally coupled to the central housing. A central brush head is rotatably coupled to and extends downwardly from the central housing. A first side brush head is rotatably coupled to and extends downwardly from the first side housing.

19 Claims, 5 Drawing Sheets

CLEANING BRUSH ASSEMBLY

BACKGROUND OF THE DISCLOSURE

1. Field of the Disclosure

The disclosure relates to brush devices and more particularly pertains to a new brush device for facilitating cleaning of curved surfaces such as the interior of bathtub.

2. Summary of the Disclosure

An embodiment of the disclosure meets the needs presented above by generally comprising a handle and a central housing coupled to a lower end of the handle. A first side housing is pivotally coupled to the central housing. A central brush head is rotatably coupled to and extends downwardly from the central housing. A first side brush head is rotatably coupled to and extends downwardly from the first side housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
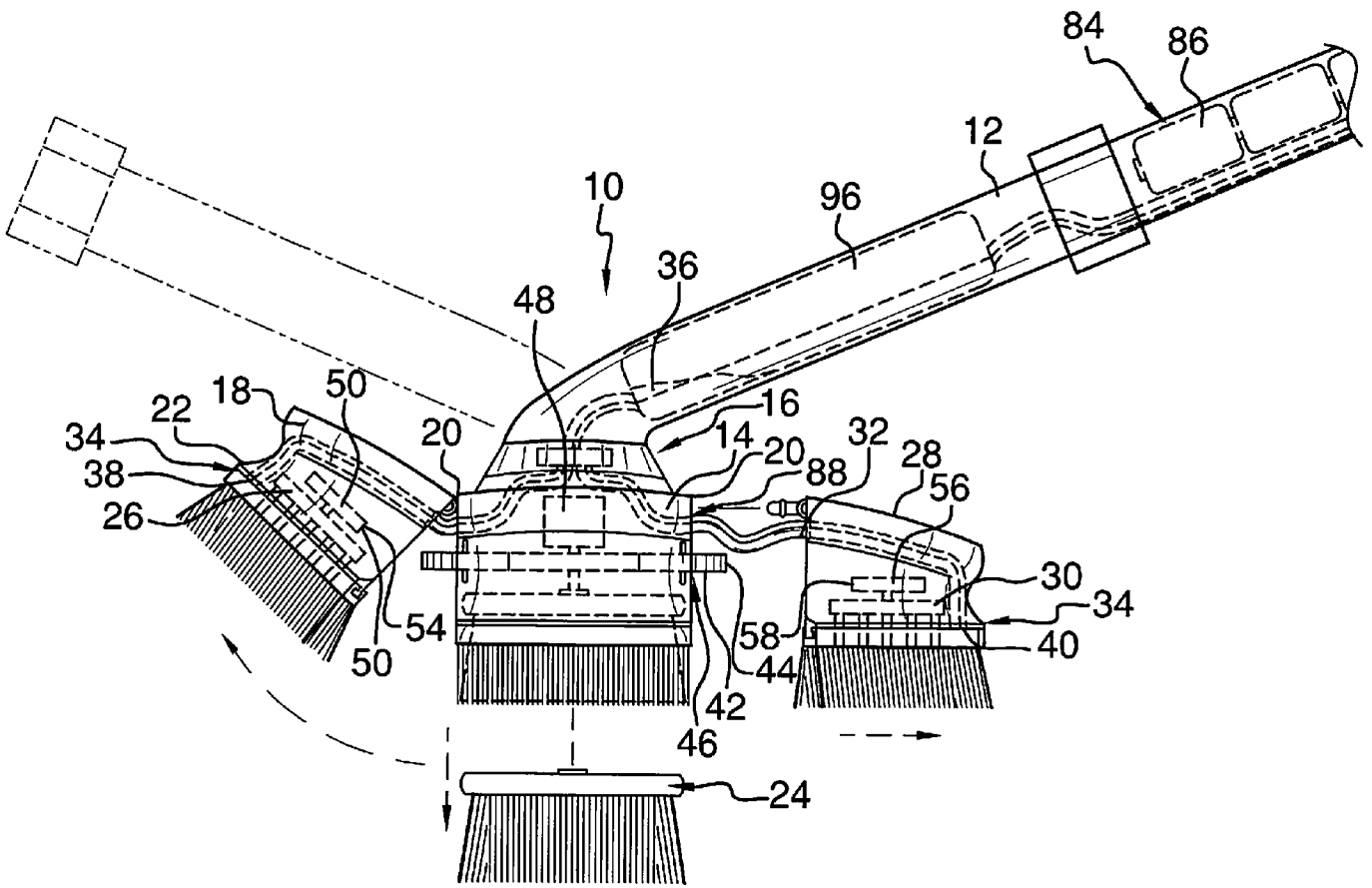
FIG. 1 is a partially exploded side view of a cleaning brush assembly according to an embodiment of the disclosure.
Figure 2:
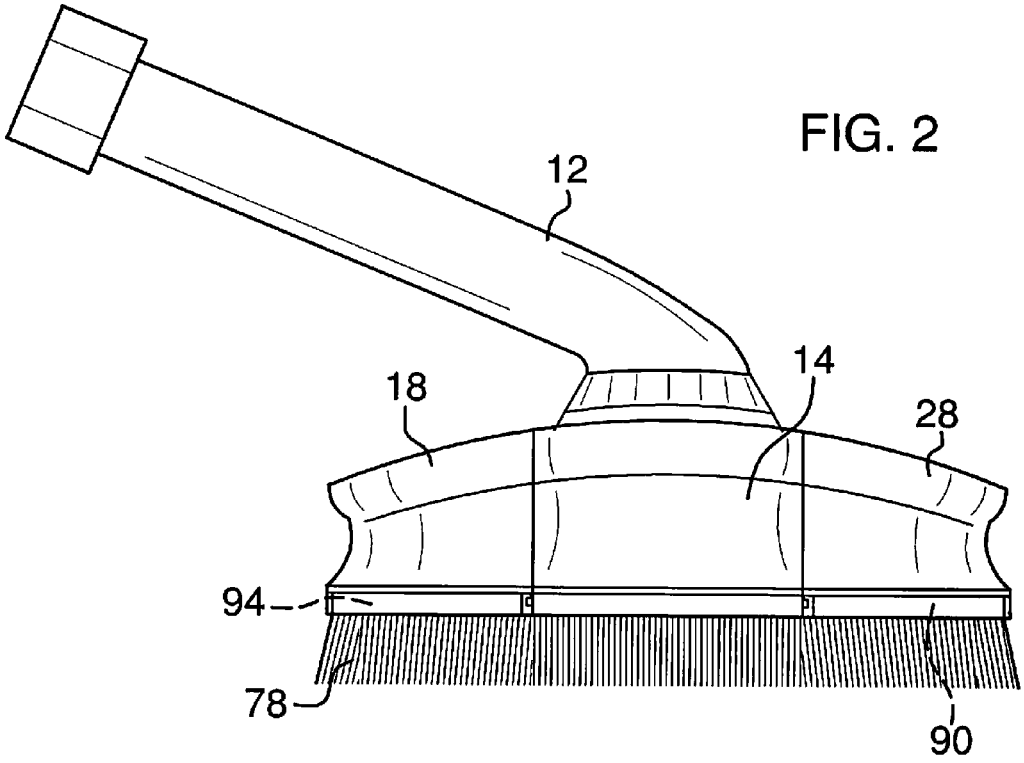
FIG. 2 is a side view of an embodiment of the disclosure.
Figure 3:
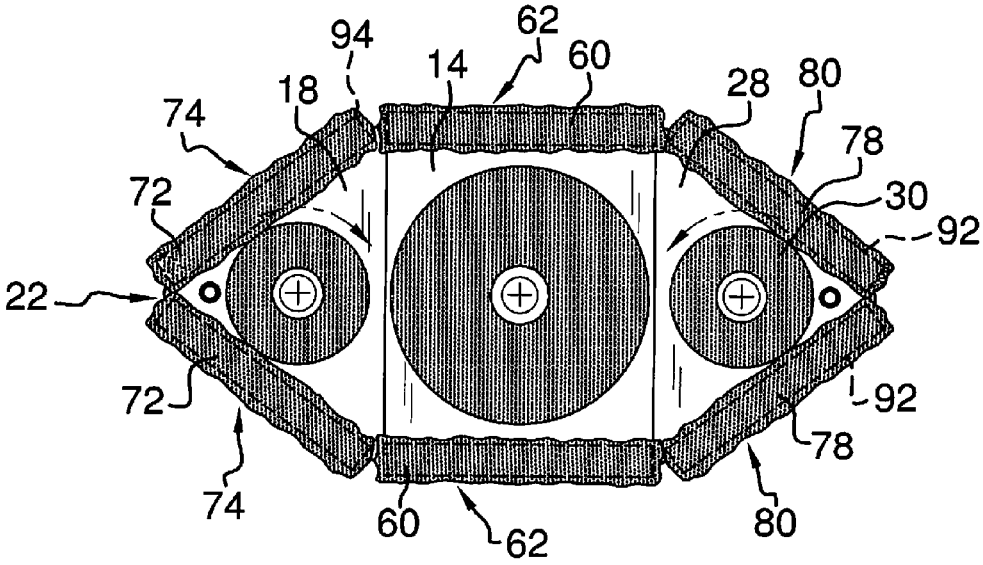
FIG. 3 is a bottom view of an embodiment of the disclosure.
Figure 4:
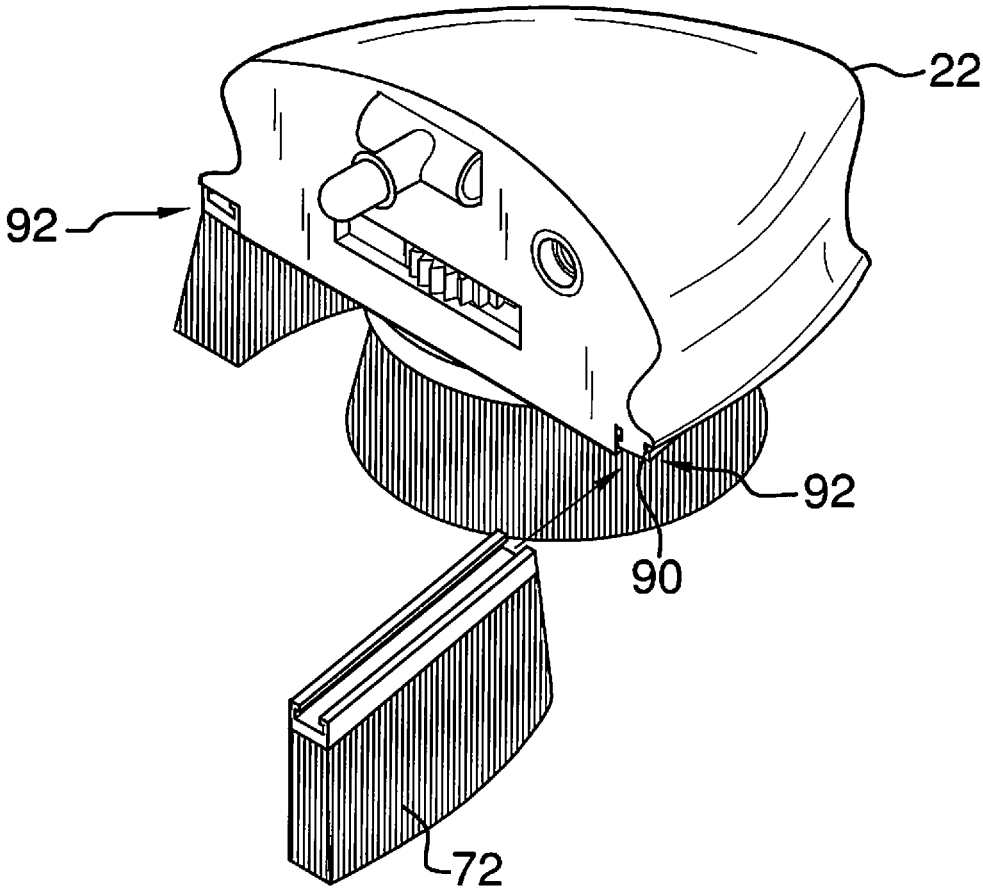
FIG. 4 is a top front side perspective view of an embodiment of the disclosure.
Figure 5:
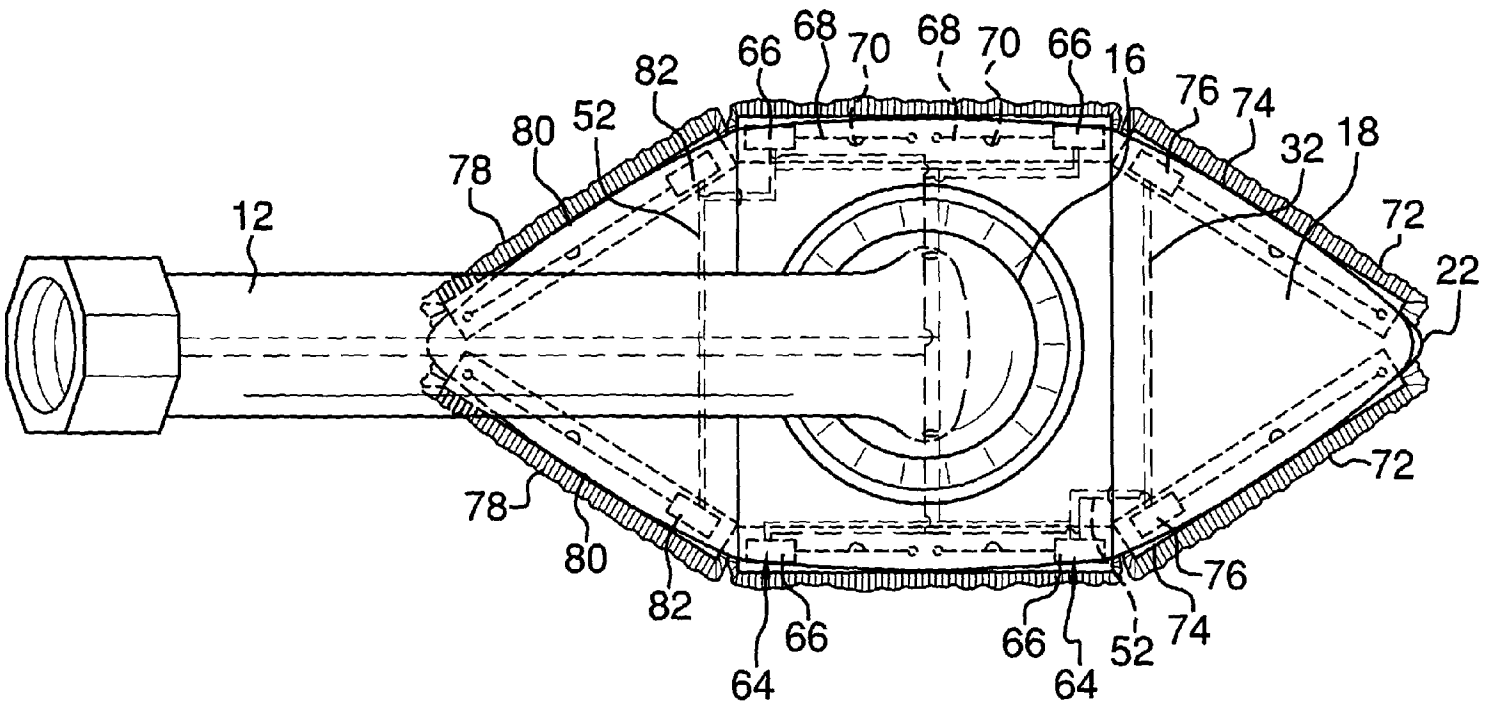
FIG. 5 is a top view of an embodiment of the disclosure.
Figure 6:
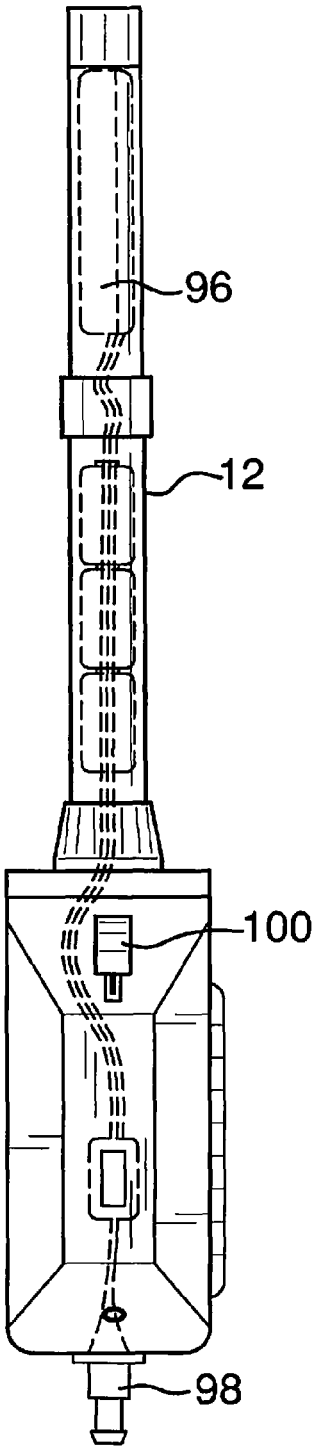
FIG. 6 is a top view of a handle assembly of an embodiment of the disclosure.
Figure 7:
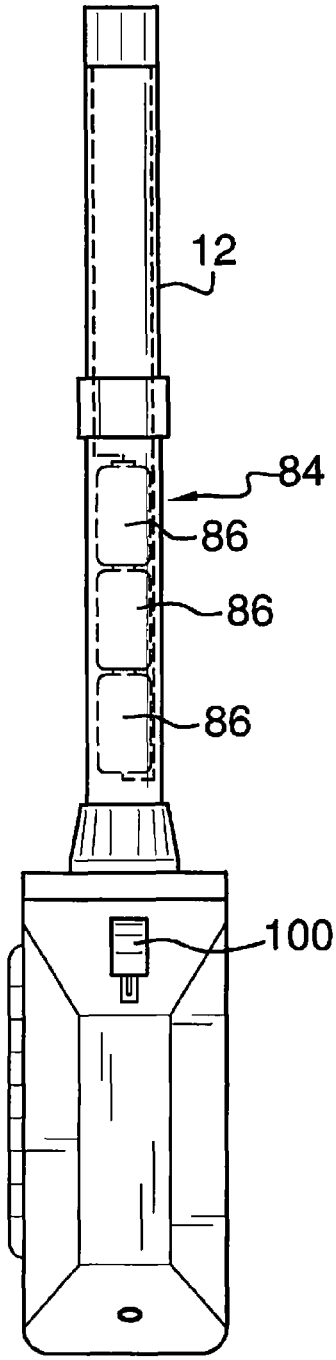
FIG. 7 is a top view of an alternative handle assembly of an embodiment of the disclosure.

With reference now to the drawings, and in particular to FIGS. 1 through 7 thereof, a new brush device embodying the principles and concepts of an embodiment of the disclosure and generally designated by the reference numeral 10 will be described.

As best illustrated in FIGS. 1 through 7, the cleaning brush assembly 10 generally comprises a handle 12 and a central housing 14 coupled to a lower end 16 of the handle 12. A first side housing 18 is pivotally coupled to the central housing 14 adjacent to a top edge 20 to permit the first side housing 18 to move on upwardly curved surfaces such as a bathtub edge or corner. The first side housing 18 further tapers extending away from the central housing 14 to facilitate positioning a point 22 of the first side housing 18 in a corner for cleaning. A central brush head 24 is rotatably coupled to and extends downwardly from the central housing 14. A first side brush head 26 is rotatably coupled to and extends downwardly from the first side housing 18. Similarly, a second side housing 28 may be similarly shaped and pivotally coupled to the central housing 14. A second side brush head 30 is rotatably coupled to and extends downwardly from the second side housing 28.

A fluid line 32 is coupled to and extends through the handle 12, the central housing 14, the first side housing 18, and the second side housing 28. A plurality of dispensing nozzles 34 is fluidly coupled to the fluid line 32 whereby fluid 36 in the fluid line 32 is dispensable through the plurality of dispensing nozzles 34. The dispensing nozzles 34 include a first side nozzle 38 coupled to the first side housing 18 and a second side nozzle 40 coupled to the second side housing 28.

A central gear 42 is coupled to and positioned in the central housing 14. The central gear 42 is operationally coupled to the central brush head 16. An outer perimeter edge 44 of the central gear 42 extends outwardly from the central housing 14 through a horizontal slot 46 adjacent to the first side housing 14. The outer perimeter edge 44 of the central gear 42 also extends outwardly from the central housing 14 adjacent to the second side housing 28. A central motor 48 is positioned in the central housing 14. The central motor 48 is operationally coupled to the central gear 42 to rotate the central gear 42. A first side gear 50 is rotatably coupled to the first side housing 14. The first side gear 50 is operationally coupled to the first side brush head 16. The first side gear 50 has a perimeter edge 54 extending outwardly from the first side housing 18 engaging the perimeter edge 44 of the central gear 42 when the first side housing 18 abuts the central housing 14 whereby the central gear 42 rotates the first side gear 50. A second side gear 56 is rotatably coupled to the second side housing 28. The second side gear 56 is operationally coupled to the second side brush head 30. The second side gear 56 has a perimeter edge 58 extending outwardly from the second side housing 28 engaging the perimeter edge 44 of the central gear 42 when the second side housing 28 abuts the central housing 14 whereby the central gear 42 rotates the second side gear 56.

A plurality of auxiliary central bristles 60 is coupled to a perimeter edge 62 of the central housing 14. A plurality of central vibrators 64 is positioned in and coupled to the central housing 14. Each central vibrator 64 may include a vibrator motor 66 and a shaft 68 with an off center weight 70. Each central vibrator 60 may be positioned adjacent to the perimeter edge 62 of the central housing 14 and the auxiliary central bristles 60 whereby the auxiliary central bristles 60 are vibrated by the central vibrator 64. Similarly, a plurality of auxiliary first side bristles 72 is coupled to a perimeter edge 74 of the first side housing 18 and each of a plurality of first side vibrators 76 is positioned adjacent to the auxiliary first side bristles 72. A plurality of auxiliary second side bristles 78 may also be coupled to a perimeter edge 80 of the second side housing 28 and a plurality of second side vibrators 82 is positioned adjacent to the auxiliary second side bristles 78.

A power source 84, such as batteries 86, may be coupled to and positioned in the handle 12. The power source 84 is electrically coupled to the central motor 48, the central vibrators 64, the first side vibrators 76, and the second side vibrators 82. The power source 84 may also be wired to other features such as a pump to direct the fluid 36 through the fluid line 32. Wiring 52 may be coextensive with the fluid line 32 extending from the central housing 14 to the first side housing 18 and the second side housing 28 through single access holes 88.

A first side track 90 may be formed in the first side housing 18 along the perimeter edge 74 of the first side housing 18. The first side track 90 may be arranged into two sections 92 tapering towards the point 22. The auxiliary first side bristles 72 may be slidably coupled to the first side track 90 to facilitate replacement. Similarly, a second side track 94 is formed in the second side housing 28 along the perimeter edge 80 of the second side housing 28. The auxiliary second side bristles 78 may also be slidably coupled to the second side track 94.

A fluid reservoir 96 may be coupled to and positioned in the handle 12. The fluid reservoir 96 is in fluid communication with the fluid line 32. Alternatively, or in combination with the fluid reservoir 96, a fluid input port 98 may be coupled to the handle 12. The fluid input port 98 is in fluid communication with the fluid line 32. A cleanser or soap may be introduced into the fluid line 32 to enhance cleaning.

In use, the assembly 10 facilitates cleaning of household surfaces by providing a combination of rotating brush heads 24,26,30 and vibrating bristles 60,72,78. Further, pivoting of the first side housing 18 and the second side housing 28 relative to the central housing 14 enhances contact and facilitates the cleaning process. Fluid 36 is delivered to the surface being cleaned as desired using a trigger mechanism 100 operationally coupled to the fluid line 32.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A cleaning brush assembly comprising:

a handle;

a central housing coupled to a lower end of said handle;

a first side housing, said first side housing being pivotally coupled to said central housing;

a central brush head, said central brush head being rotatably coupled to and extending downwardly from said central housing;

a first side brush head, said first side brush head being rotatably coupled to and extending downwardly from said first side housing;

a second side housing, said second side housing being pivotally coupled to said central housing; and a second side brush head, said second side brush head being rotatably coupled to and extending downwardly from said second side housing.

2. The assembly of claim 1, further including a fluid line coupled to and extending through said handle, said central housing, and said first side housing, said fluid line extending through said second side housing.

3. The assembly of claim 2, further comprising:

a plurality of dispensing nozzles fluidly coupled to said fluid line whereby fluid in said fluid line is dispensable through said plurality of dispensing nozzles; and said dispensing nozzles including a second side nozzle coupled to said second side housing.

4. The assembly of claim 1, further comprising:

a central gear coupled to and positioned in said central housing, said central gear being operationally coupled to said central brush head; and a central motor operationally coupled to said central gear.

5. The assembly of claim 4, further including a power source being coupled to and positioned in said handle, said power source being electrically coupled to said central motor.

6. The assembly of claim 1, further comprising:

a central gear coupled to and positioned in said central housing, said central gear being operationally coupled to said central brush head;

a central motor operationally coupled to said central gear;

said outer perimeter edge of said central gear extending outwardly from said central housing adjacent to said second side housing; and a second side gear rotatably coupled to said second side housing, said second side gear being operationally coupled to said second side brush head, said second side gear having a perimeter edge extending outwardly from said second side housing and engaging said perimeter edge of said central gear when said second side housing abuts said central housing whereby said central gear rotates said second side gear.

7. The assembly of claim 1, further including a plurality of auxiliary central bristles coupled to a perimeter edge of said central housing.

8. The assembly of claim 1, further comprising:

a plurality of auxiliary second side bristles coupled to a perimeter edge of said second side housing; and a plurality of second side vibrators, each second side vibrator being positioned adjacent to said auxiliary second side bristles.

9. The assembly of claim 8, further comprising:

a second side track being formed in said second side housing along said perimeter edge of said second side housing; and said auxiliary second side bristles being slidably coupled to said second side track.

10. The assembly of claim 2, further comprising:

a fluid line coupled to and extending through said handle, said central housing, said first side housing, and said second side housing;

a plurality of dispensing nozzles fluidly coupled to said fluid line whereby fluid in said fluid line is dispensable through said plurality of dispensing nozzles, said dispensing nozzles including a first side nozzle coupled to said first side housing, said dispensing nozzles including a second side nozzle coupled to said second side housing;

a central gear coupled to and positioned in said central housing, said central gear being operationally coupled to said central brush head, an outer perimeter edge of said central gear extending outwardly from said central housing adjacent to said first side housing, said outer perimeter edge of said central gear extending outwardly from said central housing adjacent to said second side housing;

a central motor positioned in said central housing, said central motor being operationally coupled to said central gear;

a first side gear rotatably coupled to said first side housing, said first side gear being operationally coupled to said first side brush head, said first side gear having a perimeter edge extending outwardly from said first side housing and engaging said perimeter edge of said central gear when said first side housing abuts said central housing whereby said central gear rotates said first side gear;

a second side gear rotatably coupled to said second side housing, said second side gear being operationally coupled to said second side brush head, said second side gear having a perimeter edge extending outwardly from said second side housing and engaging said perimeter edge of said central gear when said second side housing abuts said central housing whereby said central gear rotates said second side gear;

a plurality of auxiliary central bristles coupled to a perimeter edge of said central housing;

a plurality of central vibrators positioned in and coupled to said central housing, each said central vibrator being positioned adjacent to said auxiliary central bristles;

a plurality of auxiliary first side bristles coupled to a perimeter edge of said first side housing;

a plurality of first side vibrators, each first side vibrator being positioned adjacent to said auxiliary first side bristles;

a plurality of auxiliary second side bristles coupled to a perimeter edge of said second side housing; and a plurality of second side vibrators, each second side vibrator being positioned adjacent to said auxiliary second side bristles;

a power source being coupled to and positioned in said handle, said power source being electrically coupled to said central motor;

a fluid reservoir coupled to and positioned in said handle, said fluid reservoir being in fluid communication with said fluid line;

a first side track being formed in said first side housing along said perimeter edge of said first side housing, said auxiliary first side bristles being slidably coupled to said first side track; and a second side track being formed in said second side housing along said perimeter edge of said second side housing, said auxiliary second side bristles being slidably coupled to said second side track.

11. A cleaning brush assembly comprising:

a handle;

a central housing coupled to a lower end of said handle;

a first side housing, said first side housing being pivotally coupled to said central housing;

a central brush head, said central brush head being rotatably coupled to and extending downwardly from said central housing;

a first side brush head, said first side brush head being rotatably coupled to and extending downwardly from said first side housing; and a fluid line coupled to and extending through said handle, said central housing, and said first side housing.

12. The assembly of claim 11, further including a plurality of dispensing nozzles fluidly coupled to said fluid line whereby fluid in said fluid line is dispensable through said plurality of dispensing nozzles.

13. The assembly of claim 12, further including said dispensing nozzles including a first side nozzle coupled to said first side housing.

14. The assembly of claim 11, further including a fluid reservoir coupled to and positioned in said handle, said fluid reservoir being in fluid communication with said fluid line.

15. The assembly of claim 11, further including a fluid input port coupled to said handle, said fluid input port being in fluid communication with said fluid line.

16. A cleaning brush assembly comprising:

a handle;

a central housing coupled to a lower end of said handle;

a first side housing, said first side housing being pivotally coupled to said central housing;

a central brush head, said central brush head being rotatably coupled to and extending downwardly from said central housing;

a first side brush head, said first side brush head being rotatably coupled to and extending downwardly from said first side housing;

a central gear coupled to and positioned in said central housing, said central gear being operationally coupled to said central brush head;

a central motor operationally coupled to said central gear;

an outer perimeter edge of said central gear extending outwardly from said central housing adjacent to said first side housing; and a first side gear rotatably coupled to said first side housing, said first side gear being operationally coupled to said first side brush head, said first side gear having a perimeter edge extending outwardly from said first side housing and engaging said perimeter edge of said central gear when said first side housing abuts said central housing whereby said central gear rotates said first side gear.

17. A cleaning brush assembly comprising:

a handle;

a central housing coupled to a lower end of said handle;

a first side housing, said first side housing being pivotally coupled to said central housing;

a central brush head, said central brush head being rotatably coupled to and extending downwardly from said central housing;

a first side brush head, said first side brush head being rotatably coupled to and extending downwardly from said first side housing;

a plurality of auxiliary central bristles coupled to a perimeter edge of said central housing; and a plurality of central vibrators positioned in and coupled to said central housing, each said central vibrator being positioned adjacent to said auxiliary central bristles.

18. The assembly of claim 17, further comprising:

a plurality of auxiliary first side bristles coupled to a perimeter edge of said first side housing; and a plurality of first side vibrators, each first side vibrator being positioned adjacent to said auxiliary first side bristles.

19. The assembly of claim 18, further comprising:

a first side track being formed in said first side housing along said perimeter edge of said first side housing; and said auxiliary first side bristles being slidably coupled to said first side track.

* * * * *